United States Patent [19]

Rowader

[11] 4,396,125

[45] Aug. 2, 1983

[54] ADJUSTABLE CANTILEVER RACK

[75] Inventor: Richard B. Rowader, Detroit, Mich.

[73] Assignee: Palmer-Shile Company, Cincinnati, Ohio

[21] Appl. No.: 214,524

[22] Filed: Dec. 8, 1980

[51] Int. Cl.[3] ..... B01D 37/02

[52] U.S. Cl. ..... 211/193

[58] Field of Search ..... 211/193, 207, 208; 108/108; 248/242

[56] References Cited

U.S. PATENT DOCUMENTS

| | | | |
|---|---|---|---|
| 593,719 | 11/1897 | Fuller | 248/242 X |
| 3,212,648 | 10/1965 | Baker, Jr. et al. | 211/193 X |
| 3,417,872 | 12/1968 | Close | 211/208 X |
| 3,503,524 | 3/1970 | Krummell et al. | 211/193 |
| 3,554,477 | 1/1971 | D'Altrui | 211/193 X |
| 4,065,089 | 12/1977 | Frazier | 211/193 X |
| 4,311,101 | 1/1982 | Almagro | 248/242 X |

FOREIGN PATENT DOCUMENTS

| | | | |
|---|---|---|---|
| 313292 | 3/1956 | Switzerland | 248/242 |

*Primary Examiner*—Francis K. Zugel
*Assistant Examiner*—Peter A. Aschenbrenner
*Attorney, Agent, or Firm*—Thomas E. Beall, Jr.

[57] ABSTRACT

An adjustable cantilever rack containing means for accurately setting the elevational position of the outer end of the supporting arms. The cantilever rack includes a column of rectangular cross sectional shape, a base secured to the bottom of the column, a load supporting arm and a channel-shaped bracket secured to the inner end of the arm and adapted to fit around the column. Rows of circular spaced apertures formed in the column are adapted to receive bearing pins which are slidably insertable therethrough. An additional pair of apertures are formed in the flange portions of the bracket so that when aligned with the apertures in the column, a gap exists between the web portion of the bracket and the column. A pair of set screws are threadedly engaged with a corresponding pair of threaded apertures in the web portion of the bracket below the supporting arm for adjustably controlling the width of the gap and thereby adjustably controlling the elevational position of the outer end of the supporting arm.

5 Claims, 6 Drawing Figures

ADJUSTABLE CANTILEVER RACK

BACKGROUND AND SUMMARY OF THE INVENTION

The present invention relates to cantilever racks and in particular to an adjustable cantilever rack that is suitable for use in an automated storage facility.

With the increasingly widespread use of automated storage and retrieval equipment in modern storage facilities, it is becoming increasing important for cantilever-type rack for use in such facilities to have uniformly located supporting arms. In other words, to insure the proper operation of automated stacking equipment, it is important that the elevations of the arms be accurately located relative to each other so that material can be readily stored by such automated equipment without obstruction or interference from an improperly positioned arm. This is particularly important with regard to arms located at the same elevational level along the length of an aisle.

To manufacture conventional welded cantilever rack to meet such close tolerance requirements presents significant manufacturing problems. Moreover, welded rack does not readily lend itself to the replacement of a supporting arm in the event of isolated damage to the rack, nor does it provide a convenient means for adjusting the elevational position of the arms to compensate for long term variations due to loading and settling.

Accordingly, it is the primary object of the present invention to provide a cantilever-type rack having supporting arms which can readily be adjusted to provide accurate elevational positioning of the arms.

In addition, it is a further object of the present invention to provide an adjustable cantilever-type rack which affords a high degree of stability, strength and safety, and which can be constructed and assembled with a minimum of time, labor and material.

Briefly, the illustrated embodiment of the invention comprises a plurality of upwardly tapered interconnected columns each having a substantially rectangular cross section, the columns having bases in parallel relation with each base comprising a pair of interconnected elongated steel members on opposite sides of the column. Each column has rows of vertically arranged apertures preferably of rectangular shape, and these are adapted to receive pins of similar rectangular cross-sectional shape. A plurality of load supporting arms are provided, each arm being of tapered shape and having a supporting bracket secured to its wider end. The bracket is of channel-shaped construction and is adapted to fit around a column in such a manner that the load supporting arm will be tilted slightly inwardly toward the column. Each bracket has a pair of apertures of rectangular shape through which the pin extends. The apertures in the bracket are located so that when aligned with the apertures in the column for receipt of the pin, a slight gap is created between the face of the column and the inner wall of the bracket. A pair of threaded apertures are provided in the bracket below the support arm for receiving a pair of set screws which are adapted to be adjusted so that the ends of the set screws contact the face of the column. By adjusting the position of the set screws the gap between the bracket and the column is varied and the elevation of the end or "nose" of the supporting arm is adjusted accordingly.

Other objects, features and advantages of the present invention will become apparent from a reading of the detailed description of the preferred embodiment which makes reference to the following set of drawings in which:

DETAILED DESCRIPTION OF THE PREFERRED EMBODIMENT

Figure 1:
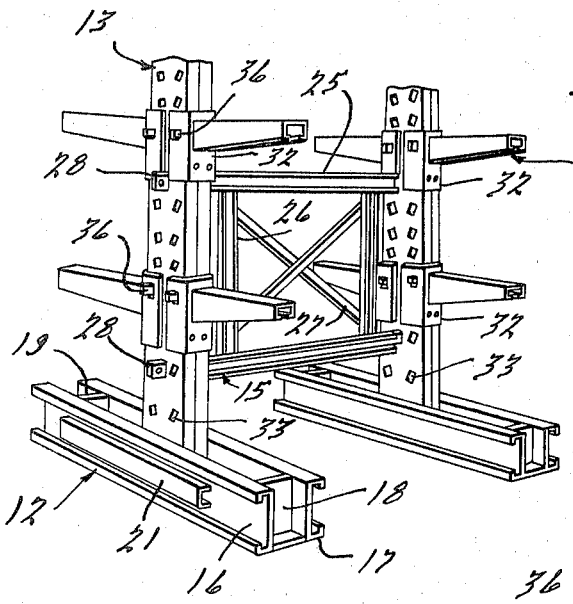
FIG. 1 is a perspective view of the lower portion of an adjustable cantilever rack constructed in accordance with the present invention.

Referring more particularly to the drawings, the rack, which is preferably formed of steel, is generally indicated at 11 and comprises a pair of bases each of which is generally indicated at 12, a pair of columns each of which is generally indicated at 13 and a plurality of load supporting arms each of which is generally indicated at 14, as well as interconnecting means generally indicated at 15 between columns 13.

Each base comprises a pair of channel-shaped members 16 and 17, these members being in back-to-back spaced relation and having inturned flanges. The backs of the members 16 and 17 are secured to the lower ends of the column 13 and to connecting plates 18 and 19 are provided at the lower ends of the members 16 and 17. Channel-shaped reinforcing bars 21 may also be provided, these being secured to the web portions of the members 16 and 17, but being shorter than the total length of the base.

Figure 3:
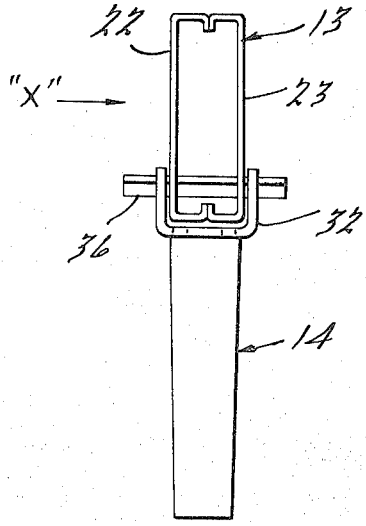
FIG. 3 is a top view of the supporting arm and column shown in FIG. 2; and FIGS. *4a–c* are side views of the supporting arm and column structure showing exaggerated representations of the variations in the elevational position of the arm obtained by adjusting the position of the set screws.

The column is preferably fabricated of two sections 22 and 23, indicated in FIG. 3, these sections being symmetrical and of generally channel shape with inturned flanges which are secured together to form a generaly rectangular open section. The shapes of the members 22 and 23 are such that, when viewed from the side designated "X" in FIG. 3, each column 13 tapers upwardly, being slightly narrower at the top than at the bottom.

Interconnecting means 15 comprises horizontal members 25, vertical members 26 and diagonal members 27. The horizontal members 25 are secured to ears 28 on the facing surfaces of the columns 13, these surfaces and the ones opposite them being those to which bases 12 are secured. It will be realized of course that any number of columns, in addition to the two illustrated, may be secured together in the manner shown in FIG. 1, each column having its own base 12 and ears 28 on its opposite sides.

Figure 2:
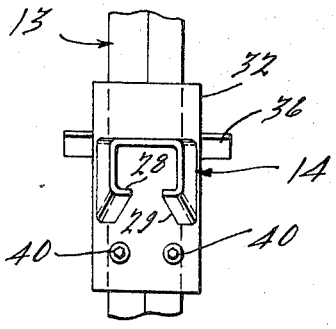
FIG. 2 is an end view of a supporting arm of the rack shown in FIG. 1.

In the embodiment of the invention illustrated, each support arm 14 has a generally inverted U-shaped cross-section with the free ends 28 and 29 on the underside of the arm 14 turned inwardly, as shown in FIG. 2. Each supporting arm 14 is shaped so that it tapers in a direction away from column 13, when viewed from either the top or the side, as seen in FIGS. 3 and 4 respectively, thus enabling a substantial saving in material while taking into account the variation in shear and bending loads along the arm.

The wider end of each supporting arm 14 is provided with a mounting bracket 32 comprising a channel-shaped member, the web portion of which is secured to the wider end of the arm 14 and the sides of which are adapted to fit around the surfaces of the column 13 to which the base 12 is attached. The construction is such that when the web portion of each bracket 32 is parallel to the facing surface of the column 13, as seen in FIG. 4*a*, the upper surface of the corresponding arm 14 will be tilted slightly upwardly and inwardly.

In the double-sided rack shown (the rack may also be made with the supporting arms extending only from one side of the columns), four rows of apertures 33 are provided in each column 13, the rows being in two pairs with apertures in each pair of rows being horizontally alinged in a direction at right angles to supporting arms 14 and at any desired vertical spacing. The apertures 33 are preferably of inclined rectangular shape, that is, with their side edges extending downwardly and away from the surfaces of the column 13 which face the supports 14.

Figure 4A:
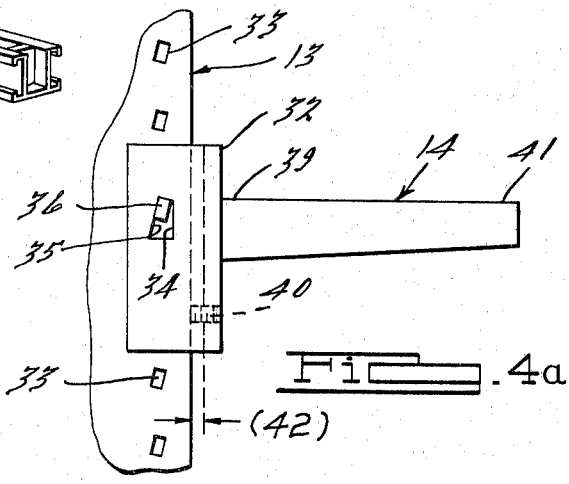

The flanges of the brackets 32 are preferably wide enough to overlap several pairs of aligned apertures 33 when the brackets 32 are placed in the positions shown in FIG. 4. The upper flange portions of each bracket have a pair of horizontally aligned apertures 34 preferably of trapezoidal shape, the apertures 34 in the bracket 32 being larger in both directions than the apertures 33 in the column 13. The side edge 35 of each aperture 34 facing away from the supporting arm 14 is inclined at the same angle as the side edges of apertures 33 in column 13. A pin 36 of rectangular cross-section is insertable through the apertures 33 and 34, as best shown in FIG. 3, when the pair of apertures 34 in the bracket 32 are aligned with a pair of apertures 33 in the column 13. The cross-sectional shape of the pins 36 is such that they will be slidably receivable by apertures 33 but without appreciable play once inserted. The location of the apertures 34 in the bracket 32 is such that when aligned with the apertures 33 in the column 13 to permit insertion of the pin 36, a gap 42 is created between the facing of the column 13 and the web portion of the bracket 32 as shown in FIG. 4*a*.

Located below the supporting arm 14 in the web portion of the bracket 32 is a pair of horizontally aligned threaded apertures which are adapted to receive a pair of set screws 40. The threaded apertures in the bracket 32 are preferably spaced apart as much as possible while still insuring that the set screws 40 will contact the flat facing of the column 13. In addition, the set screws 40 utilized in the illustrated embodiment have flat point contact surfaces to prevent the creation of bearing identations in the facings of the columns 13. It is also preferred that the set screws 40 have a nylon patch applied to their threads to insure tight engagement and prevent movement of the set screws 40 due to vibration.

Figure 4B:
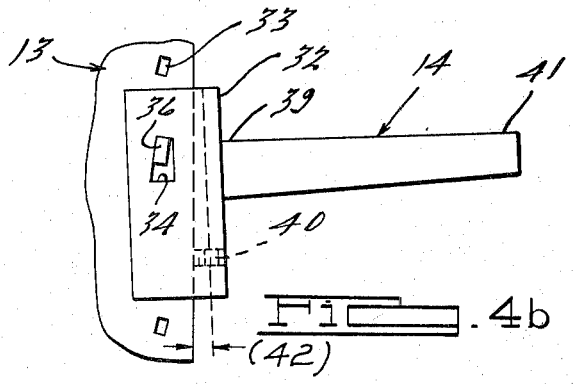
Figure 4C:
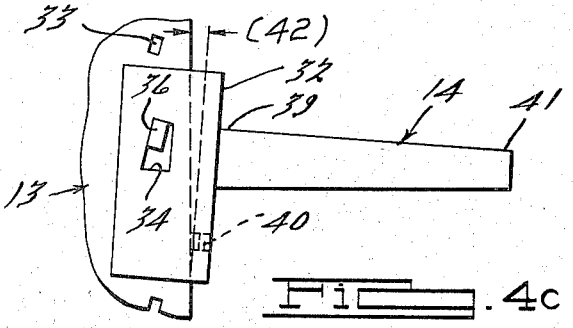

The function of the set screws 40 is illustrated in FIGS. 4*a–c*. With the bearing pin 36 contacting the upper edge of aperture 34 of racket 32, the elevation of the top surface of the supporting arm 14 at the wide end or "heel" 39 of the arm 14 is accurately located. The position of the set screws 40 can then be adjusted to properly set the elevation of the free end or "nose" 41 of the supporting arm. Specifically, it will be appreciated that when the set screws 40 are adjusted, the supporting arm 14 will pivot approximately about the heel 39 of the arm where it joins the bracket 32. This is due to the fact that the apertures 34 in the bracket 32 are located so that the upper edge of the apertures which contact the bearing pin 36 are substantially aligned with the top surface of the supporting arm 14. In this manner, when the set screws 40 are adjusted, thereby varying the gap 42 between the column 13 and the web of the bracket 32, only the elevation of the nose end 41 of the arm 14 is affected. Thus, accurate orientation of the arm 14 relative to the column 13 is possible. Moreover, even if the elevation of the nose end 41 of the arm 14 should subsequently change due to loading or settling, the position of the set screws 40 can readily be further adjusted to compensate for the variation. Thus, accurate positioning of the supports arms 14 can be maintained.

While the above description constitutes the preferred embodiment of the present invention, it will be appreciated that the invention is susceptible to modification, variation and change without departing from the proper scope or fair meaning of the accompanying claims.

What is claimed is:

1. An adjustable cantilever rack including a column of rectangular cross-section shape, a base secured to the bottom of said column, a load supporting arm, a channel-shaped bracket having a web portion secured to the inner end of said arm and flange portions adapted to fit around said column, rows of vertically spaced first apertures in said column, said first apertures having substantially flat bottom edges, a pair of second apertures in said flange portions of said bracket having substantially flat top edges and being vertically oriented in said bracket so as to be substantially aligned horizontally with the top surface of said supporting arm and being horizontally oriented in said bracket so that when aligned with one of said first apertures in said column a gap exists between said web portion of said bracket and said column, a substantially rectangular-shaped bearing pin insertable through said first and second apertures when aligned such that said flat top edges of said second apertures are supported by and in contact with the top surface of said bearing pin and the bottom surface of said bearing pin is supported by and in contact with said flat bottom edges of said first apertures, and at least one set screw threadedly engaged with a third aperture in said web portion of said bracket below said supporting arm and in contact with said column for adjustably controlling the width of said gap and thereby adjustably controlling the elevational position of the outer end of said supporting arm.

2. The adjustable cantilever rack of claim 1 wherein a pair of set screws are provided which are threadedly engaged with a corresponding pair of spaced-apart threaded apertures in said web portion of said bracket below said supporting arm.

3. The adjustable cantilever rack of claim 1 wherein adjustment of said set screw is adapted to cause said supporting arm to pivot substantially about the joint between the top surface of said supporting arm and said web portion of said bracket.

4. The adjustable cantilever rack of claim 3 wherein said top edges of said second apertures are substantially alinged horizontally with the top surface of said supporting arm.

5. The adjustable cantilever rack of claim 1 wherein said set screw has a flat end contact surface.

* * * * *